United States Patent [19]

Greb

[11] 4,336,912

[45] Jun. 29, 1982

[54] WINDING DEVICE

[75] Inventor: Manfred Greb, Huckeswagen, Fed. Rep. of Germany

[73] Assignee: Barmag Barmer Maschinenfabrik AG, Remscheid, Fed. Rep. of Germany

[21] Appl. No.: 139,095

[22] Filed: Apr. 10, 1980

[30] Foreign Application Priority Data

Apr. 12, 1979 [DE] Fed. Rep. of Germany ..... 2914923

[51] Int. Cl.[3] ..... B65H 54/54; B65H 65/00; B65H 75/28

[52] U.S. Cl. ..... 242/46.4; 242/18 PW; 242/19; 242/35.5 R

[58] Field of Search ..... 242/46.4, 46.2, 46.3, 242/46.5, 46.6, 18 DD, 18 PW, 18 R, 18 A, 35.5 R, 19, 25 R, 25 A, 72 R, 72.1

[56] References Cited

U.S. PATENT DOCUMENTS

| | | | |
|---|---|---|---|
| 2,931,587 | 4/1960 | Pistor | 242/18 PW |
| 3,030,039 | 4/1962 | Roberts | 242/18 PW |
| 3,801,038 | 4/1974 | Wust | 242/18 PW X |
| 4,002,307 | 1/1977 | Turk et al. | 242/18 PW X |
| 4,014,476 | 3/1977 | Turk et al. | 242/18 DD X |
| 4,056,237 | 11/1977 | Miller et al. | 242/18 PW |
| 4,106,711 | 8/1978 | Oswald et al. | 242/18 PW X |
| 4,155,512 | 5/1979 | Bauch | 242/18 PW X |
| 4,223,849 | 9/1980 | Schippers et al. | 242/46.4 |

*Primary Examiner*—Stanley N. Gilreath
*Attorney, Agent, or Firm*—John H. Shurtleff

[57] ABSTRACT

A chucking spindle in a winding device with means for synchronizing the clamping and releasing movements of the clamping elements for the spool or bobbin tube and the gripping elements for the initial thread applied during thread transfer.

20 Claims, 4 Drawing Figures

1
2
3
4
5
6
7
8
9
10
11
12
13
14
15
16
17
18
19
20
21
22
23
24
28
29
44
II
II

WINDING DEVICE

BACKGROUND OF THE INVENTION

The invention relates to a winding device for the loss-free winding of a continuous thread, especially a thread composed of synthetic fibers, onto at least one spool tube releasably clamped on a rotatably mounted chucking spindle.

Such a winding device is known, for example, from U.S. Pat. No. 4,014,476 (DE-PS No. 24 55 116). The apparatus of this patent comprises at least one turnably borne chuck, i.e. a chucking spindle, containing circumferentially distributed clamping elements which are movable in a cage for the clamping and releasing of at least one spool tube, these clamping elements being radially movable relative to the cage. This apparatus further includes spacing means to fix the positions of the spool tubes as well as thread catching and thread holding elements for catching and securing a thread onto each spool at the beginning of the thread transfer in the winding process.

In this known apparatus, the spacing means have been lug or cam-like projections which extend in axial direction on one facing end of each spool tube, while a thread catching and thread holding element is formed in this same facing end in the form of a thread catching notch at a position which is angularly offset with reference to the spacing projection. With this known apparatus, it is a disadvantage that special spool tubes must be used, particularly those tubes which are relatively fragile due to their spacing projections so as to be easily damaged during transport and handling of the spools. Also, as one-way tubes or sleeves required to face in the correct direction, these non-standard tubes require special handling and are too expensive for many yarn producers and cause their products to be less competitive.

The following patents offer special thread catching and holding means as part of the chucking spindle: U.S. Pat. No. 3,801,038 (DE OS No. 22 48 875); and U.S. Pat. No. 4,106,711 (DE OS No. 27 47 771). With these known thread catching and holding means for securing the thread at the beginning of the winding, e.g. in the thread transfer from a wound spool to an empty spool, the thread holding gap remains open during the axial draw-off of the wound spool tube but is closed during winding by an element having a round or polygonal cross section extending in the form of a ring around one end of the spindle in order to exert a pressure on the thread perpendicularly or transversely to its running direction. Such apparatus cannot be readily adapted to the loading of more than one spool tube onto a chucking spindle.

SUMMARY OF THE INVENTION

It is an object of the present invention to provide an improved chucking spindle in a winding device to coordinate the clamping and releasing movements of thread catching and holding means with the clamping elements for the spool tube, particularly by suitable linking means arranged within the chucking spindle to provide a positive synchronization of the thread holding and tube clamping elements. Another object of the invention is to permit two or even more spool tubes to be loaded and doffed from a single chucking spindle with the use of special spacing or positioning means arranged on the chucking spindle, especially in combination with the synchronized clamping elements. Special thread severing or separating elements are also provided in a preferred embodiment of the invention. Other objects and advantages of the invention will become more apparent from the following detailed disclosure.

The improvement according to the present invention is provided in a winding device designed to achieve a loss-free winding of a continuous thread, yarn, filament or the like, i.e. where a continuously running thread is wound onto one spool after another without any substantial loss of thread during the changeover of the winding from a practically full spool to the next empty tube. This type of winding device includes at least one turnably borne chucking spindle containing circumferentially distributed clamping elements movable radially in a cage means for clamping and releasing at least one spool tube carried on an outer mantle shell of said spindle, spacer means for fixing each spool tube position, and thread catching and holding means for catching and securing a thread on the spool tube during thread transfer at the beginning of the winding on said tube, this thread holding means being releasable when drawing off the wound spool tube. For purposes of the present invention, the cage means must be movable, either axially or rotatably, on the chucking spindle in order to direct the tube clamping elements outwardly and inwardly between a clamping position and a releasing position, respectively, and linking means are also provided to operatively connect the thread holding means with the cage means to synchronize the securing and releasing movements of the thread holding means with the clamping and releasing movements of the clamping elements for the spool tube. The linking means preferably provides a direct mechanical connection between the cage means and the thread holding means, i.e. so that a mechanical linkage coordinates the various clamping elements.

The preferred thread holding means according to the present invention is one which includes a gripping element arranged axially parallel to the chucking spindle axis, preferably with a round or polygonal cross section and adapted to exert a line pressure extending at right angles or transversely of the circumferential winding position of the thread.

In this preferred embodiment, the thread is clamped fast between the clamping element and an axially projecting segment of the mantle sleeve of the chucking spindle. This axially projecting segment serves not only to provide one side of the clamping element but is also constructed to act as a thread catching and thread guiding element in the transfer of the thread from an almost fully wound spool to an empty spool tube.

The synchronized operation of the thread gripping element with the clamping elements for the spool tube advantageously takes place through a piston-cylinder unit having at the end of the piston an actuating member which operates over coupling members to move the thread gripping element in and out of its thread holding or clamping position.

The winding device of the invention preferably further includes spacer means incorporated in the chucking spindle in order to fix each spool tube position so as to fulfill the function of the lug-type or cam-like projections previously located on one end face surface of each spool tube, thereby permitting the use of standard tubes having normal flat-surfaced ends. The structural elements provided as the spacer means are distinguished in that they are each resiliently mounted in an annular element between two adjacent cages of the chucking spindle. The spacer is arranged to extend radially outwardly beyond the mantle shells of the chuck, in order to provide a stop surface which extends in a plane normal to the chuck axis for contact with the end face surface of the empty spool tube. However, the spacer radially projects beyond the mantle shells or outer spindle surface by an amount which is less than or, in the case of a resilient bearing, slightly greater than the difference between the inside spool tube diameter and the outer diameter of the mantle shells. Thereby, it is possible to slip two or more spool tubes onto a correspondingly long chuck. Thus, if the spool tube to be slipped on strikes against the stop surface of the spacer, then it needs to be lifted only slightly radially in order to slide it over and along the spacer and to bring it into the next desired position. If required, the spacer may also be pressed slightly radially inwardly due to its resilient mounting. In drawing off a full spool from the chucking spindle, the spool tube slides over a steep plane on the side away from the stop surface and presses the spacer radially inwardly under the influence of the spool weight.

For the winding of synthetic threads and especially carpet yarns having coarse deniers, i.e. large yarn sizes, the winding device of the invention preferably includes a thread separating or severing element associated with each thread catching and holding means and arranged on the chuck circumference at an angularly offset position with respect to the thread catching and holding means. All of the thread separating or severing elements in their preferred form have cutting edges which lie radially below or inwardly of the mantle shell surrounding the spool tube clamping elements and the cage means. This arrangement avoids injuries to the operating personnel as might otherwise be caused by the cutting edges, especially in the insertion of the spool tubes onto the chucks or in other activities requiring hand operations at or along the chucking spindle.

These and other preferred embodiments and features of the invention are described in the remaining specification and the claims which form a part of the original specification, it being understood that the illustrated subject matter is directed to a preferred form of the invention without restricting the invention thereto.

THE DRAWINGS

The invention is explained in greater detail in the following portion of the specification with the aid of the accompanying drawing wherein.

Figure 1:
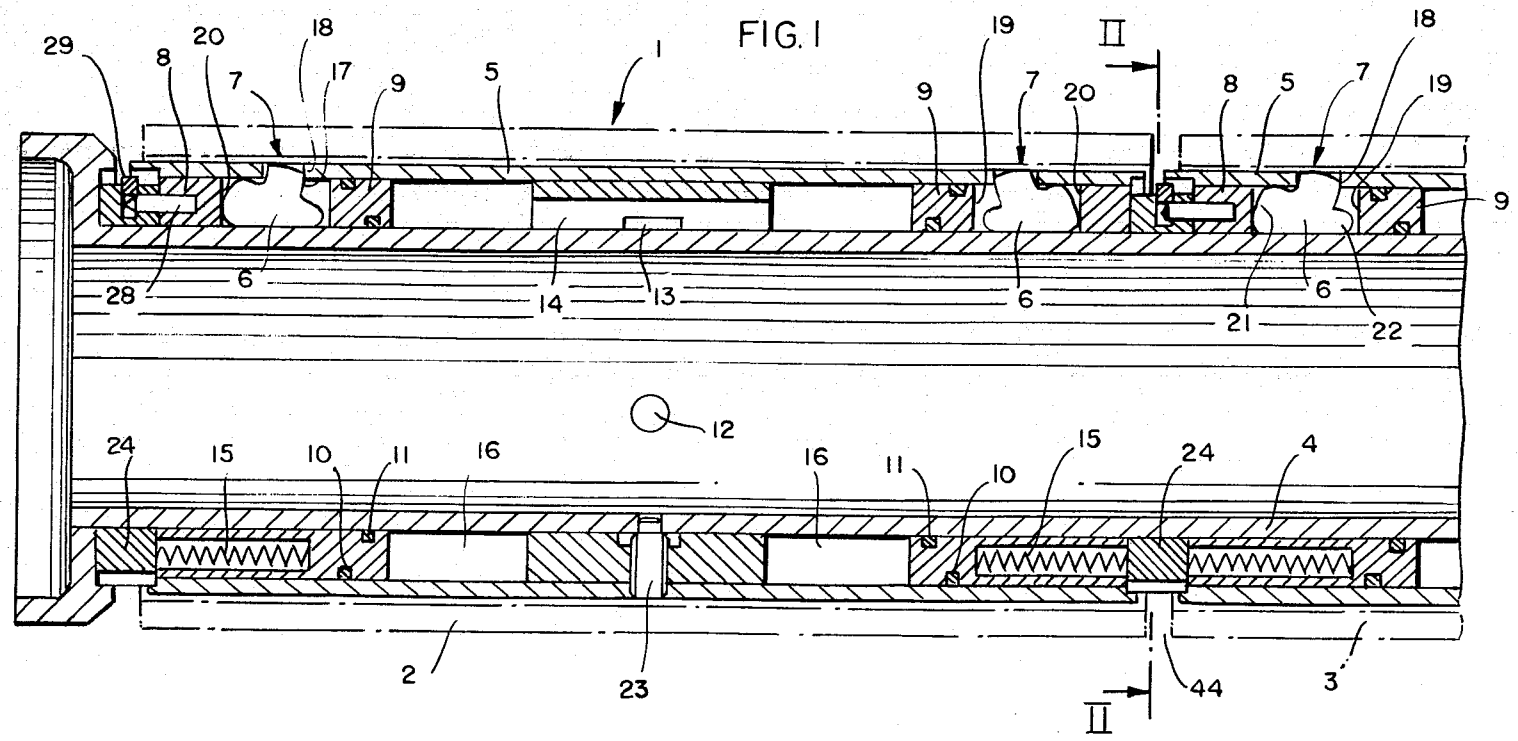
FIG. 1 is a longitudinal section taken on line I—I of FIG. 2 of one embodiment of the chuck according to the invention.

Referring first to FIG. 1, there is generally shown a chucking spindle 1 of a winding device according to the invention, the spindle being adapted to receive a plurality of donned spool tubes 2, 3 slidable from right to left into slightly spaced positions along the spindle axis. Such a chuck is used, for example, in winding machines for synthetic threads in order to continuously wind one or more threads individually onto the spool tubes. A typical winding machine which has a spool or bobbin revolver with two rotatably mounted chucks is described, for example, in U.S. Pat. No. 4,014,476 (DE PS No. 24 55 116) and U.S. Pat. No. 4,002,307 (DE PS No. 24 61 223), the details of these earlier patents being included herein by reference as fully as if set forth in their entirety in order to describe the entire winding device, preferably as adapted for high speed winding operations.

The general principle of one preferred construction for the chucking spindle 1 is fully disclosed in U.S. Application Serial No. 61,747, filed July 30, 1979, now U.S. Pat. No. 4,223,849, corresponding to the German application No. 28 54 715.1, this prior disclosure also being incorporated herein by reference as fully as if set forth in its entirety.

In the interspace formed between the chuck shaft 4 and the mantle shell 5, a clamping element 6 is provided at a number of selected points to provide the corresponding clamping positions 7. Between the chuck shaft 4 and the mantle shell 5, there is also arranged an annular piston 9 constructed as the cage 8, which is radially sealed by means of suitable ring on the inside and outside surfaces where the piston is in sliding contact with the chuck shaft 4 and the mantle shell 5, respectively. When taken together, this shaft 4, the shell 5 and the annular piston 9 form a piston-cylinder unit. This unit can be acted upon by a pressure fluid such as compressed air over a distributor feed channel (as shown by the cross section in FIG. 6 of said Ser. No. 61,747 or any similar feed channel) running axially in the chuck shaft 4. From this feed channel, the fluid acts outwardly through radial bores 12 into the annular grooves 13 and then through the axial distributor channels 14. The compressed air can be supplied from a plant compressed air system in a conventional manner.

The pistons 9 are arranged symmetrically with respect to the annular groove 13 and to the distributor channel 14 and are moved axially by the air pressure against the action of the circumferentially positioned springs 15 in order to release the clamping elements 6 which are shown in their release or non-clamping position in FIG. 1. Upon turning off the air pressure and expanding or ventilating the cylinders 16, the annular pistons 9 are pushed back by the resiliently biased springs 15 into a starting or clamping position, the clamping elements 6 being moved radially outwardly and clamped fast against the spool tubes 2,3. Here, the convex curved slide surfaces 17 of the clamping elements 6 are guided on the corresponding slide edges 18 of the recesses or openings in the mantle shell 5. In the sliding movement of the clamping elements 6 between the chuck shaft 4 and the mantle shell 5, the axial limiting surfaces 19,20 of the cage 8 act as thrust elements which engage the larger slide end 21 of the clamping element to cause an outwardly directed gripping pressure on the inner wall of the spool tube and, in the opposite direction, these limiting surfaces engage the smaller lug 22 of the clamping element 6 for the release of the spool tube. Other types of clamping elements are equally suitable when moved by a cage member.

According to the invention, between each two successive mantle shells 5 secured by a threaded rod or pin 23 with respect to the chuck shaft 4, there is inserted a ring element 24 on which there are arranged a spacing or positioning device 26 and a thread severing device 27. This same ring element 24 is also arranged between the first fully inserted spool tube 2 and the mounting head 45 of the chuck shaft 4. The thread gripping element 25, which is represented in greater detail in FIGS. 2 and 3, cooperates with an actuating foot member 28 which is press fitted into the face surface of the annular piston 9, i.e. one end of the respective chuck cages 8. The actuating foot 28 is preferably formed as a fitting pin with a protruding conical point so as to provide a sloping working edge, i.e. an edge oblique to the longitudinal axis of the chuck shaft. As the annular piston 9 travels to the left (FIG. 1), the foot 28 engages under the free end 29 of the two-armed swivel lever 31 carried on the pivot point 30 and in synchronized action with the releasing of the clamping elements 6 for the spool tubes 2,3 releases the initially wound thread end or starter tail which is gripped tightly between the gripping element 25 and an axial projection 32 of the mantle shell 5.

It should be pointed out that the movement of the cage 8 for the clamping of the spool tubes 2,3 can also be restricted to a rotary movement or one may also adopt a rotary movement added to the axial shifting movement, in the event that this arrangement is regarded as more desirable. Such alternative constructions are well known in this art and reference is made to the references already cited above.

The thread gripping element 25 is preferably constructed as a gripping body with a round or polygonal cross section which is fastened parallel to the longitudinal axis of the chuck shaft and rigidly to the end 33 of the swivel lever 31. It can be moved radially by the actuating foot 28, together with the swivel lever 31, in a corresponding recess of the ring element 24. In this radial movement, its path is limited on the one hand by a compression spring 34 and on the other hand by the axial projection 32 as a stop member on the mantle shell 5. The compression spring 34 itself lies in the radial bore 35 in the ring element 24 and is supported on the circumference of the chuck shaft 4, on the one hand, and on the underside of the end 33 of the swivel lever 31, on the other hand.

Figure 2:
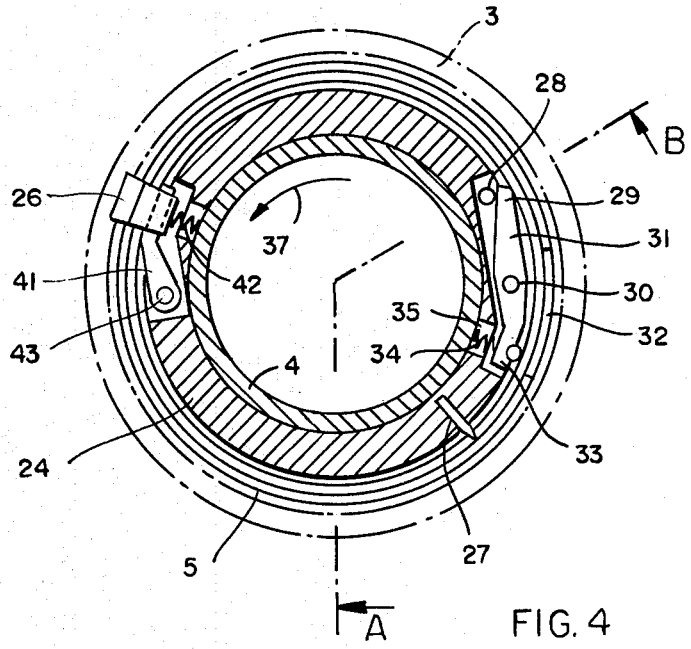
FIG. 2 is a cross section of the chuck taken on line II—II of FIG. 1.
Figure 3:
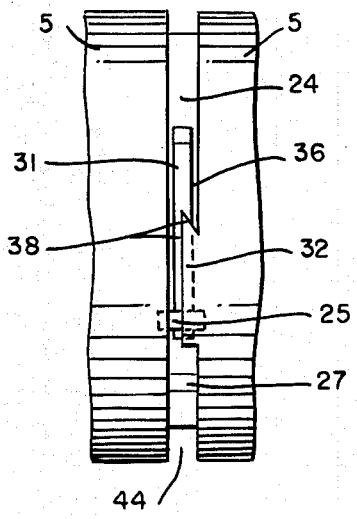
FIG. 3 is a partial side view showing a thread catching and gripping element incorporated into the chuck of FIGS. 1 and 2.
Figure 4:
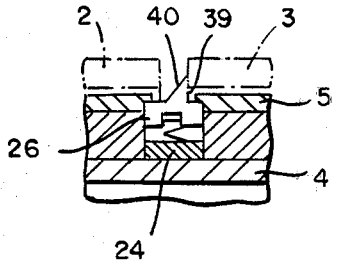
FIG. 4 is an angularly offset partial longitudinal section of the same chuck as FIG. 3 taken on line IV—IV of FIG. 2 to illustrate the details of a spacer or positioning means for the spool tubes.

The axially projecting stop member 32 against which the thread gripping element 25 is radially pressed, extends—as shown in FIGS. 2 and 3—over a portion of the circumference of the mantle shell 5. The stop 32 is formed as a thread catching element with a V-shaped notch 36 and, as seen in the turning direction (arrow 37) of the chuck 1, has a thread guide edge 38 which is chamfered or beveled to receive the thread on its outer circumferential end surface and then into the V-notch. The lowest point of the thread guide edge 38, i.e. of the rear-most trailing edge of the V-shaped notch 36, lies preferably on the face surface of the adjoining mantle shell 5, in order to define the point to which the incoming thread is moved after it is caught up by the mantle shell. About 15 angular degrees behind the thread gripping position as viewed in the turning direction 37, a thread severing device is installed in the ring element 24. The thread severing device 27 has a radial cutting edge that lies back behind the mantle shell 5 (see FIGS. 2 and 3).

The course of the thread T at the particular moment when it is changed over from a fully wound bobbin to an empty tube 3 is illustrated in FIGS. 2 and 3, the thread forming the looped path $T_1$ and $T_2$ as it is guided by the lower thread guide G from the full bobbin onto the empty tube 3. One end of this loop $T_1$ is caught at the V-notch 36 and runs over the circumferential surface of the ring element 24. The other end of the thread loop $T_2$ lies around part of the spool tube 3. During the changeover, the thread $T_1$ runs from a stationary thread guide (not shown) located above the winding unit down to the gripping element 25 of the chuck on which the empty bobbin tube 3 is held, being caught up by the V-notch 36, and then loops back up through the auxiliary guide G as thread $T_2$ which is still in the process of being taken up on the full bobbin. Once the thread $T_1$ is clamped tightly by the thread gripping means 25,32, the chuck continues to rotate until the cutting edge of the severing device 27 contacts and cuts the thread $T_1$ so that the portion $T_2$ cut free will be removed with the full bobbin.

As will be seen in FIG. 3, the ring element 24 is preferably dimensioned with respect to its width in such a way that an annular gap 44 is provided between the adjacent mantle shells 5,5 of the chuck 1. In taking up the incoming thread by means of the thread catching element 36, the introduced thread, as a consequence of its tension and the rotation of the chuck 1, is drawn between the thread gripping element 25 and the axial projection or stop 32 formed as an opposing gripping surface, and the thread is clamped tightly at this position until the chuck 1 is again acted upon with compressed air for releasing the thread and drawing off the finished spool. At the same time, the thread loop formed in the thread transfer process which still runs onto the full spool is cut off by the cutting edge of the thread severing device 27.

In a position which is preferably about diametrically opposite to the thread gripping means 25,32, there is arranged the spacing or positioning means 26 for the spool tubes 2,3. This spacer 26 has a stop surface 39, which extends in a normal plane to the axis of the chuck shaft and faces the cantilevered free end of the chuck 1, while the surface 40 turned away from this free end is constructed as a steep sloping plane, thereby facilitting the drawing off of the full spools. The spacing means or spacer element 26—as best seen in FIG. 2—is supported swingably on the lever arm 41 and is also supported by a compression spring 42 so as to be elastically tensioned or resiliently urged radially outwardly from the chuck shaft 4. The lever arm 41 is carried parallel to the axis of the chuck shaft so as to pivot at 43 in the ring element 24. In this manner, the spacing means 26 during the ejection of the full spools can be plunged down and away under the mantle shell 5 of the chuck 1. After removing the radial load of the full spool, the compression spring 42 causes the spacer 26 to again emerge radially. Reloading of the empty spools is accomplished quite easily by depressing the spacer 26 against spring 42 as the tube 2 or 3 slides thereover. The invention thereby provides a simple loading and doffing of spools or bobbins while accurately maintaining the proper spool positions, all with conventional spool tubes having normal flat end surfaces.

The invention is hereby claimed as follows:

1. In a winding device for the loss-free winding of a continuous thread including at least one turnably borne chucking spindle containing circumferentially distributed clamping elements movable radially in cage means for clamping and releasing at least one spool tube carried on an outer mantle shell of said spindle, spacer means for fixing each spool tube position, and thread catching and holding means for catching and securing a thread on the spool tube during thread transfer at the beginning of the winding on said tube, said thread holding means being releasable for drawing off the wound spool tube, the improvement which comprises:

at least one cage means movable on the chucking spindle to direct said tube clamping elements radially outwardly and inwardly between a clamping position and releasing position, respectively; and linking means operatively connecting the thread holding means with said cage means to synchronize the securing and releasing movements of the thread holding means with the clamping and releasing movements of said clamping elements for the spool tube.

2. A winding device as claimed in claim 1, wherein the cage means is mechanically connected by said linking means with the thread holding means.

3. A winding device as claimed in claim 1, wherein the thread holding means includes a gripping element having a round or polygonal cross section arranged axially parallel to the chucking spindle axis.

4. A winding device as claimed in claim 3, in which the gripping element is an elongated body exerting a line pressing action to hold said thread.

5. A winding device as claimed in claim 3, wherein the gripping element is swingably mounted on one end of a two-armed swivel lever having its pivot axis arranged parallel to the chucking spindle axis.

6. A winding device as claimed in claim 5, wherein the path of said two-armed lever is limited in radial direction, outwardly by an axially projecting stop member arranged on an outer mantle shell of the chucking spindle, said projection extending over a part of the circumference of said mantle shell, and inwardly by an elastic tensioning means which is placed under tension by the swivel movement of said lever.

7. A winding device as claimed in claim 6, wherein the tensioning means is a compression spring.

8. A winding device as claimed in claim 6, including a piston-cylinder unit arranged on the chucking spindle for the movement of said cage means, said unit having an annular piston operable by a fluid pressure medium and connected with each cage, and an actuating foot mounted on the end of said piston such that when the cage is moved in the releasing direction of the clamping elements, the actuating foot works under the free end of said two-armed lever and moves said free end radially outwardly, thereby releasing the thread holding means.

9. A winding device as claimed in claim 8, wherein the actuating foot has a sloping working edge.

10. A winding device as claimed in claim 8, wherein the actuating foot is a conical adjusting pin.

11. A winding device as claimed in claim 6, wherein the axially projecting stop member on the mantle shell is constructed as a thread catching element and, as viewed in the turning direction of the chucking spindle, provides a thread guide edge.

12. A winding device as claimed in claim 11, wherein the projecting stop member, as viewed in the turning direction of the chucking spindle, contains a notch-shaped recess that extends from its leading edge in axial and in circumferential direction with its rear-most trailing edge being arranged at about the facing end surface of the adjoining mantle shell.

13. A winding device as claimed in claims 10, 11 or 12, wherein an annular gap is provided between the axially projecting stop member located on an adjoining mantle shell and the flat end surface of an adjacent mantle shell.

14. A winding device as claimed in claim 1, wherein the spacer means for the fixing of each spool tube position is resiliently mounted in an annular element between two adjacent cage means and projects radially beyond the two mantle shells by an amount which is less than up to slightly greater than the difference between the inside diameter of the spool tube and the outside diameter of the mantle shells.

15. A winding device as claimed in claim 14, wherein the spacer means extends radially outwardly to provide a stop surface which extends in a plane normal to the chucking spindle axis, said stop surface facing toward the cantilevered free end of the chucking spindle, the rear surface of the spacer means turned away from the stop surface being formed as a steep inclined plane.

16. A winding device as claimed in claim 14, wherein the spacer means is swingably supported on a lever arm and is supported on an elastic tensioning means.

17. A winding device as claimed in claim 16, wherein the pivot axis of said lever arm supporting the swingable spacer means is secured in said annular element located between two adjacent cages so as to extend axially parallel to the chucking spindle axis.

18. A winding device as claimed in claim 14, wherein each spool tube is provided with a spacing means.

19. A winding device as claimed in claim 1, wherein for each thread catching and thread holding means associated with each spool tube, there is provided in the chucking spindle a circumferentially offset thread severing element.

20. A winding device as claimed in claim 19, wherein said thread severing element has a cutting edge placed radially below the mantle shell surrounding the spool tube clamping elements and the cage means.

* * * * *